US011346301B1

(12) United States Patent
Stark et al.

(10) Patent No.: US 11,346,301 B1
(45) Date of Patent: May 31, 2022

(54) PISTON HAVING SMOOTHED OUTER CROWN SURFACE IN DEPOSIT-SENSITIVE ZONE

(71) Applicant: Caterpillar Inc., Peoria, IL (US)

(72) Inventors: Paul Kenneth Stark, Peoria, IL (US); Michael Stevan Radovanovic, Dunlap, IL (US); James Atkinson, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/095,957

(22) Filed: Nov. 12, 2020

(51) Int. Cl.
*F02F 3/00* (2006.01)
*F02F 3/26* (2006.01)

(52) U.S. Cl.
CPC ..... *F02F 3/0015* (2013.01); *F02F 3/26* (2013.01)

(58) Field of Classification Search
CPC .... F02F 3/00; F02F 3/0015; F02F 3/26; F02F 2003/0007; F02B 23/06; F16J 1/001; F16J 1/02; B23P 15/10
See application file for complete search history.

(56) References Cited

U.S. PATENT DOCUMENTS

| | | | | |
|---|---|---|---|---|
| 6,736,101 | B2 | 5/2004 | Kano et al. | |
| 6,817,333 | B2 * | 11/2004 | Wang | F02F 3/00 123/193.2 |
| 7,543,557 | B2 | 6/2009 | Wang | |
| 9,359,971 | B2 * | 6/2016 | Donahue | F02F 3/0076 |
| 2004/0045521 | A1 * | 3/2004 | Wang | F02F 3/00 123/193.1 |
| 2004/0241023 | A1 * | 12/2004 | Pinkerton, III | F04B 53/162 417/461 |
| 2010/0319647 | A1 * | 12/2010 | Ogawa | C22C 21/02 123/193.2 |
| 2013/0084190 | A1 | 4/2013 | Bewlay et al. | |
| 2017/0121839 | A1 * | 5/2017 | Yamashita | C25D 11/246 |
| 2017/0145952 | A1 * | 5/2017 | Lineton | C23C 4/11 |
| 2018/0128166 | A1 * | 5/2018 | Lineton | F02F 3/0084 |

FOREIGN PATENT DOCUMENTS

| | | | |
|---|---|---|---|
| EP | 3043054 | A1 | 7/2016 |
| JP | 2002089361 | A | 3/2002 |
| JP | 2009127459 | A * | 6/2009 |
| KR | 20190102206 | A | 9/2019 |

OTHER PUBLICATIONS

Michael S. Radovanovic, Specification and Drawings for U.S. Appl. No. 16/671,614 Grading a Piston With Deposits Using Measurement Data, filed Nov. 1, 2019.
Seth C. Studnicka, Specification and Drawings for U.S. Appl. No. 16/671,650 Grading a Piston With Deposits Using Thermal Scan Data, filed Nov. 1, 2019.
Seth C. Studnicka, Specification and Drawings for U.S. Appl. No. 16/671,679 Grading a Piston With Deposits Using Measurement Data and Thermal Scan Data, filed Nov. 1, 2019.

* cited by examiner

*Primary Examiner* — Grant Moubry
(74) *Attorney, Agent, or Firm* — Brannon Sowers & Cracraft

(57) ABSTRACT

A piston for an internal combustion engine includes a piston crown having a crown outer surface forming piston lands alternating axially with piston ring grooves together with the piston lands defining a deposit-sensitive zone. The crown outer surface is smoothed to inhibit deposit formation and/or adhesion within at least a portion of the deposit-sensitive zone to a roughness average (Ra) of 0.0002 millimeters or less, and in a refinement to a mirror finish Ra of 0.000125 or less.

18 Claims, 3 Drawing Sheets

PISTON HAVING SMOOTHED OUTER CROWN SURFACE IN DEPOSIT-SENSITIVE ZONE

TECHNICAL FIELD

The present disclosure relates generally to a piston for an internal combustion engine, and more particularly to a piston having surfaces selectively smoothed to inhibit deposit formation and/or adhesion.

BACKGROUND

Internal combustion engines employ one or more pistons positioned in a combustion cylinder and movable by way of a controlled combustion reaction within the cylinder to rotate a crankshaft. A great many different fueling, temperature, and pressure control strategies relating to the combustion process have been proposed over the years. Fuel can be directly injected into the cylinder, port injected, or fumigated into a stream of intake air to name a few examples. In the case of directly injected internal combustion engines, commonly operating on a liquid hydrocarbon fuel such as a diesel distillate fuel, the fuel spray is often directed into a combustion bowl in an effort to confine the combustion process to the combustion bowl, although in some instances injected fuel can be directed or spilled over a rim of the piston and wet the wall of the cylinder, typically formed by a cylinder liner. These and other operating and/or fueling strategies are employed to various ends, including emissions mitigation, efficiency optimization, and still others. A flow of engine oil is provided for distribution between the wall of the cylinder and the piston and piston rings to lubricate the interfacing surfaces.

In virtually all engines, and diesel engines in particular, it is common to experience deposit accumulation upon parts of the piston regardless of the operating and fueling regime. Deposits can be observed notably upon parts of the piston and piston rings that face the cylinder wall. Varying of fuel delivery strategies such as that noted above, or perturbations to desired operating parameters, in the dynamic combustion environment can make deposit formation relatively difficult to predict and mitigate. Moreover, goals relating to emissions and efficiency, for example, often take precedence over deposit mitigation even where the mechanisms of deposit accumulation are understood or suspected. Variations in fuel quality and fuel type can further impact the manner and extent of deposit formation.

Engineers have experimented previously with mechanical deposit management techniques, such as deposit scrapers, in an effort to manage formation of such deposits. Excessive piston deposits can interfere with lubricating oil distribution, increase oil consumption, and cause or exacerbate a phenomenon known as "blow-by" where combustion gases escape the cylinder through a clearance between the piston rings and the cylinder wall. One example of a piston deposit mitigation effort is set forth in EP 3043054 A1 and proposes a carbon scraping cuff ring that apparently assists in scraping off undesired deposits from combustion surfaces.

SUMMARY OF THE INVENTION

In one aspect, a piston for an internal combustion engine includes a piston body having a piston crown defining a piston center axis, and a piston skirt attached to the piston crown. The piston skirt includes a skirt outer surface and a skirt inner surface. The piston crown includes a crown outer surface, and a combustion face formed by an annular outer rim surface and a combustion bowl surface radially inward of the annular outer rim surface. The crown outer surface forms a plurality of piston lands alternating axially with a plurality of piston ring grooves and together defining a deposit-sensitive zone. At least one of the skirt outer surface or the skirt inner surface has a roughness number (Ra) of 0.002 millimeters or greater, and the crown outer surface is smoothed within at least a portion of the deposit-sensitive zone to an Ra of 0.0002 millimeters or less.

In another aspect, a piston for an internal combustion engine includes a piston body having a piston crown defining a piston center axis, and a piston skirt attached to the piston crown. The piston crown includes a crown outer surface, and a combustion face formed by an annular outer rim surface and a combustion bowl surface radially inward of the annular outer rim surface. The crown outer surface forms a plurality of piston lands alternating axially with a plurality of piston ring grooves and together defining a deposit-sensitive zone. The piston crown is formed throughout of a piston body material having an exposed surface smoothness that is varied within the piston crown, and a roughness average (Ra) of 0.0002 millimeters or less within at least a portion of the deposit-sensitive zone.

In still another aspect, a method of preparing a piston for service in an internal combustion engine includes receiving a piston body of the piston including a piston crown defining a piston center axis and having a crown outer surface extending circumferentially around the piston center axis and formed by an exposed piston body material extending throughout the piston crown. The method further includes decreasing a surface roughness of the piston crown by at least one of removal or deformation of the exposed piston body material in a deposit-sensitive zone of the piston body defined by a plurality of piston lands and a plurality of piston ring grooves each formed by the crown outer surface. The method still further includes increasing a smoothness of the exposed piston body material based on the decreasing of the surface roughness to a deposit-inhibiting smoothness that is at least an order of magnitude smoother than a smoothness in a deposit-insensitive zone of the piston body.

DETAILED DESCRIPTION

Figure 1:
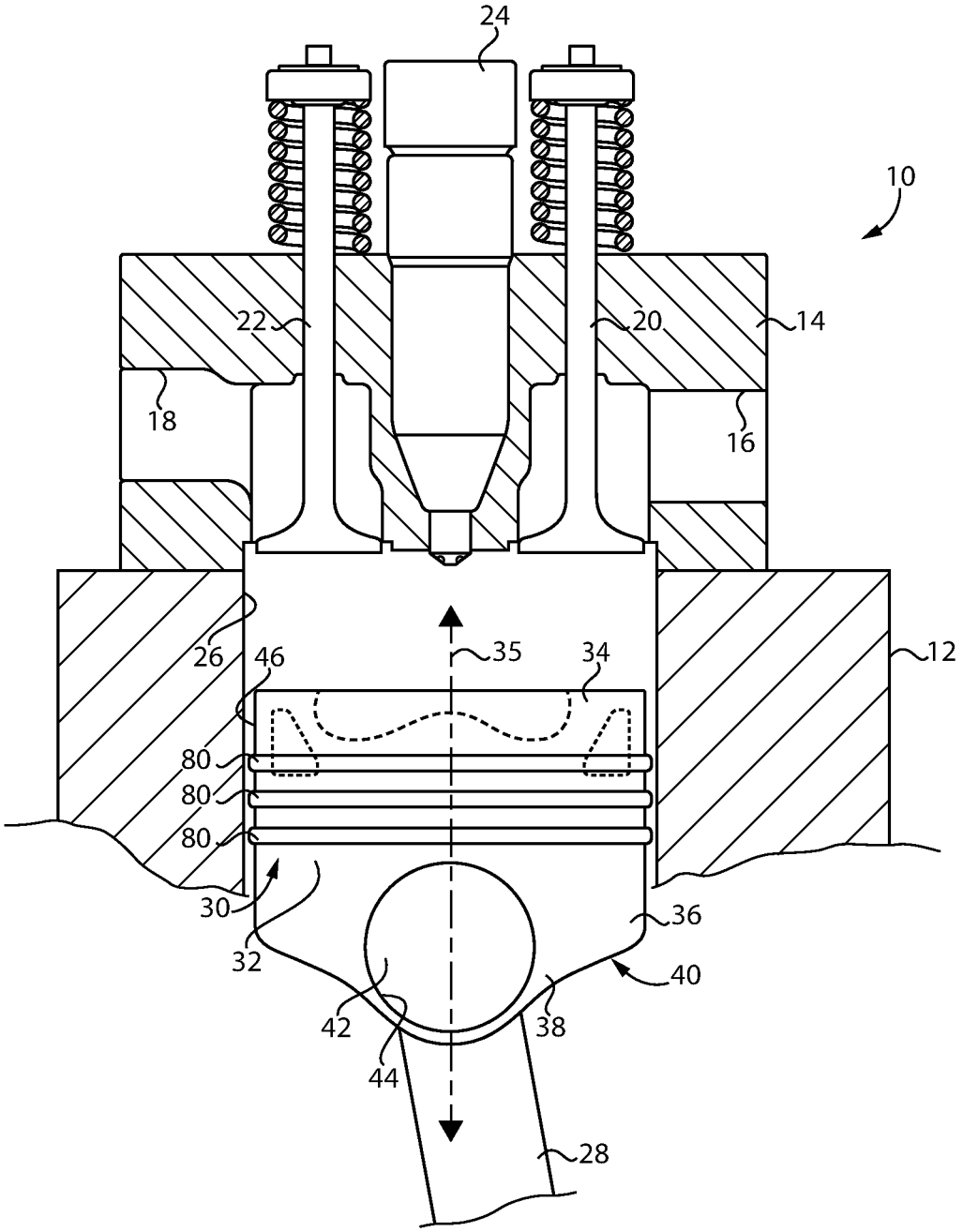
FIG. 1 is a partially sectioned side diagrammatic view of an internal combustion engine, according to one embodiment.

Referring now to FIG. 1, there is shown an internal combustion engine 10 according to one embodiment. Internal combustion engine 10 includes a cylinder block 12 and an engine head 14 attached to cylinder block 12. An intake conduit 16 is formed in engine head 14 as well as an exhaust conduit 18. An intake valve 20 is movable to control fluid communication between intake conduit 16 and a combustion cylinder 26 formed in cylinder block 12. An exhaust valve 22 is movable to control fluid communication between cylinder 26 and exhaust conduit 18. A fuel injector 24 is shown supported in engine head 14 and positioned to directly inject a liquid fuel into cylinder 26. Engine 10 also includes a connecting rod 28 coupled with a piston 30 positioned within cylinder 26 and operable to rotate a crankshaft in a generally conventional manner. Internal combustion engine 10 may include a compression-ignition engine operable upon a liquid hydrocarbon fuel, such as a liquid diesel distillate fuel. Other fuels and fuel blends such as bio-diesel could also be used. Cylinder 26 may be one of any number of cylinders in any suitable arrangement such as a V-pattern, an inline pattern, or still another. As will be further apparent from the following description, piston 30 may be structured to reduce or eliminate formation and/or adhesion of deposits, such as carbon or carbonized material, thereon.

Piston 30 includes a piston body 32 having a piston crown 34 defining a piston center axis 35. Piston body 32 also includes a piston skirt 36 attached to piston crown 34. Piston crown 34 and piston skirt 36 may be formed by separate pieces attached by any suitable process, such as a friction welding process, although a uniformly single-piece piston falls within the scope of the present disclosure. Piston skirt 36 includes a skirt outer surface 38 and a skirt inner surface 40, obscured in the view of FIG. 1. A wrist pin bore 44 is formed in piston skirt 36 and supports a wrist pin 42 coupling connecting rod 28 to piston 30 in a generally conventional manner.

Figure 2:
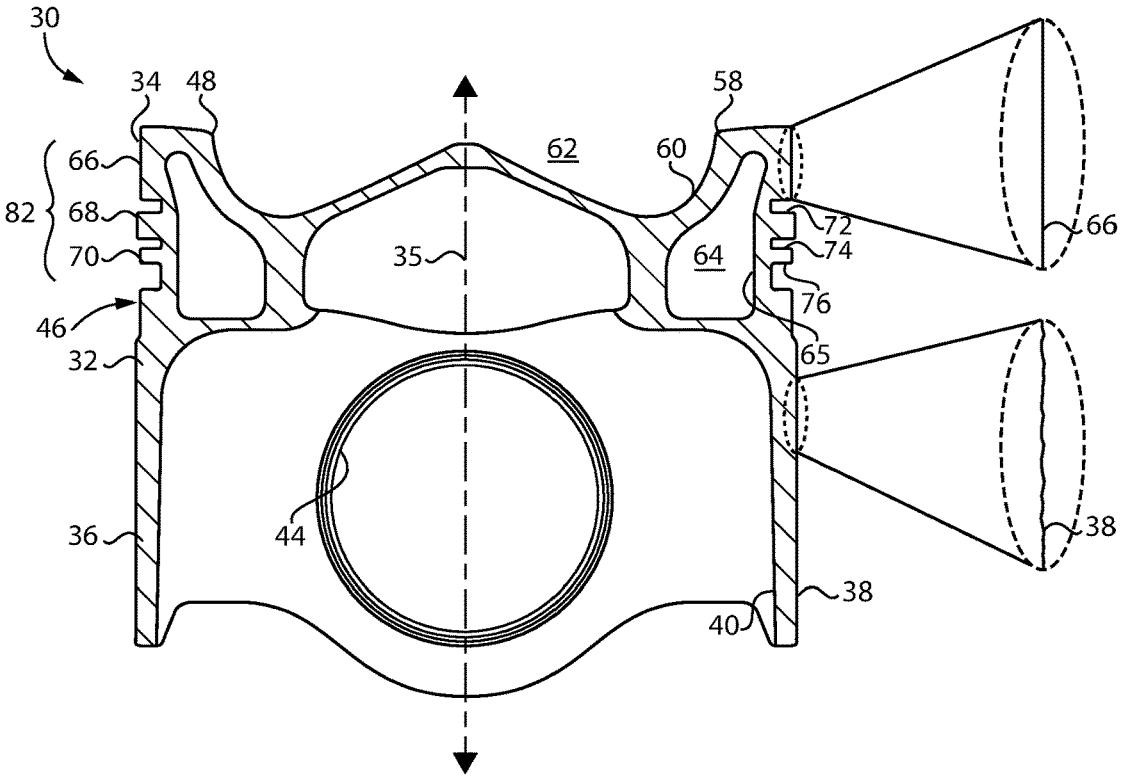
FIG. 2 is a sectioned side diagrammatic view of a piston, including detailed enlargements, according to one embodiment.

Referring also now to FIG. 2, piston crown 34 includes a crown outer surface 46, and a combustion face 48 formed by an annular outer rim surface 58 and a combustion bowl surface 60 radially inward of annular outer rim surface 58. Combustion bowl surface 60 forms a combustion bowl 62. Piston crown 34 and piston skirt 36 may further include gallery surfaces 65 forming an oil gallery 64, typically having one or more downwardly opening ports or the like to receive a spray of cooling and lubricating oil directed upward from a conventional oil sprayer, and a drain.

Crown outer surface 46 forms a plurality of piston lands including a top land 66, a second land 68, and a third land 70. Piston lands 66, 68, 70 alternate axially with a plurality of piston ring grooves also formed by crown outer surface 46. The plurality of piston ring grooves can include a top ring groove 72, a second ring groove 74, and a third or bottom ring groove 76. Pistons having other numbers of piston lands and/or piston ring grooves are within the scope of the present disclosure. The plurality of piston lands and the plurality of piston ring grooves each extend circumferentially around piston center axis 35 and together define a deposit-sensitive zone 82.

In a practical implementation strategy, piston crown 34 is formed throughout of a piston body material. Piston skirt 36 may also be formed throughout of the same piston body material. Piston body 32, including piston crown 34 and piston skirt 36 may be cast, forged, or formed by another suitable process such as an additive manufacturing process. The piston body material may be iron, steel, stainless steel, aluminum, or various other metals and alloys. As suggested above, piston 30 is adapted to inhibit formation and/or adhesion of certain deposits.

To this end, crown outer surface 46 may be smoothed within at least a portion of deposit-sensitive zone 82 to a roughness average (Ra) of 0.0002 millimeters (0.20 microns) or less. According to another characterization, crown outer surface 46 may be smoothed to a root mean square (RMS) roughness of 11 micro-inches or less. In a refinement, crown outer surface 46 is smoothed within the subject portion of deposit-sensitive zone 82 to an Ra of 0.00015 millimeters or less, and in a further refinement smoothed to a mirror-finish Ra of 0.000125 millimeters or less.

The smoothness of the subject portion of crown outer surface 46 is considered to limit or, depending upon service conditions, potentially eliminate the formation and/or adhesion of deposits thereon. In some embodiments, the smoothness of an entirety of crown outer surface 46 might be an Ra of 0.0002 millimeters or less, 0.00015 millimeters or less, or 0.000125 millimeters or less. It has been observed that an increased smoothness of at least a portion of deposit-sensitive zone 82, relative to deposit-insensitive zones of piston body 32, can provide some improvement with regard to deposit formation and/or adhesion. An "increased" smoothness means a reduced roughness average Ra, a reduced RMS roughness, or a reduced roughness by some other measure, relative to a given standard, such as starting roughness of the subject surface or a roughness of another surface that is not thusly smoothed.

In some implementations less than all of crown outer surface 46 and less than all of deposit-sensitive zone 82 may be thusly smoothed. For example, in one embodiment top land 66 is smoothed to an Ra of 0.0002 millimeters or less, or to or less than one of the still smoother Ra values listed herein. In a further embodiment, crown outer surface 46 is smoothed within each of top land 66, second land 68, and third land 70 to the Ra of 0.0002 millimeters or less, or to or less than one of the still smoother Ra values listed herein. In combination with the smoothing of one or more of piston lands 66, 68, and 70, or independently, at least one of piston ring grooves 72, 74, and 76 may be smoothed to the Ra of 0.0002 millimeters or less, or to or less than one of the still smoother Ra values listed herein.

As suggested above, some of piston body 32, including some of piston crown 34 may be relatively smoother than other parts of piston body 32 and/or piston crown 34. Thus, the piston body material from which piston crown 34 is formed may have an exposed surface smoothness that is varied within piston crown 34, such as having a different smoothness upon combustion face 48 as compared to a smoothness upon crown outer surface 34 within deposit-sensitive zone 82. In an implementation, at least one of skirt outer surface 38 or skirt inner surface 40 might have an Ra of 0.002 millimeters or greater, with the piston body material having an exposed surface smoothness that is smoothest in deposit-sensitive zone 82 and varying by at least an order of magnitude between deposit-sensitive zone 82 and skirt outer surface 38 or skirt inner surface 40, or still another less smooth surface of piston body 32. Stated another way, within at least a portion of deposit-sensitive zone 82, crown outer surface 34 may be at least ten times smoother than other surfaces of piston crown 32 and/or piston skirt 36. Skirt outer surface 38 or skirt inner surface 40 might be or include a deposit-insensitive zone of piston body 32 where deposit formation and/or adhesion is less likely or not observed at all. Combustion face 48 may also be or include a deposit-insensitive zone of piston body 32.

FIG. 2 includes a detailed enlargement showing exposed piston body material forming top land 66, and another detailed enlargement showing exposed piston body material of skirt outer surface 38. At least microscopically, the difference in smoothness of the piston body material forming the respective surfaces can be expected to be observable. Machining marks upon skirt outer surface 38 may be blurred but visible and having an apparent direction, under magnification using light microscopy. Upon top land 66 machining marks may be visible but apparent direction may not be visible, under light microscopy magnification.

Figure 3:
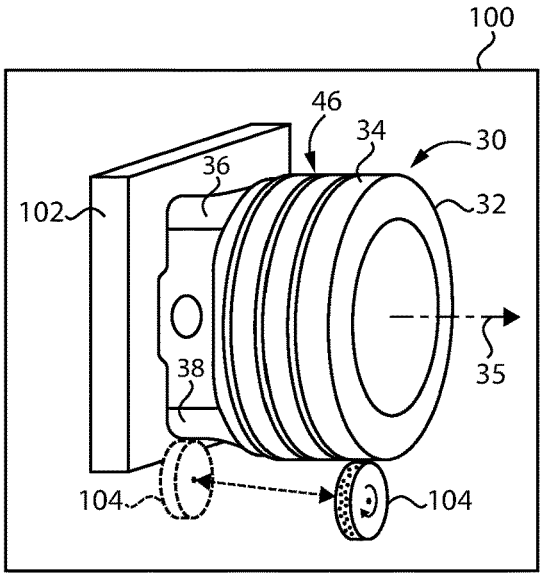
FIG. 3 is a diagrammatic view of a piston at a processing stage, according to one embodiment.
Figure 4:
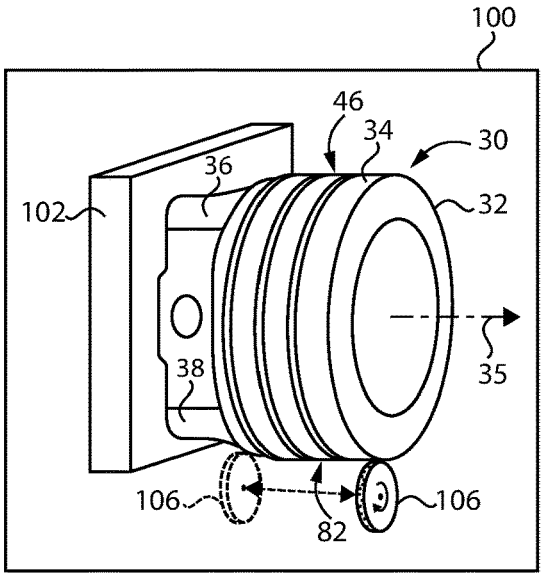
FIG. 4 is a diagrammatic view of a piston at another processing stage, according to one embodiment.

Referring now also to FIG. 3, there is shown piston 30 as it might appear at a processing stage supported by a fixture 102 in a processing cell 100. A tool 104, such as a grinding wheel, is shown as it might appear in contact with crown outer surface 34, and movable generally axially along crown outer surface 34 and along skirt outer surface 38. Tool 104 can be used to remove or deform exposed piston body material of piston body 32 to achieve a specified surface texture including an Ra. Referring also to FIG. 4, there is shown piston 30 still supported with fixture 102 in processing cell 100 and now depicted as it might appear with a different tool 106 that is used only for removal or deformation of exposed piston body material in deposit-sensitive zone 82 of crown outer surface 34. Tool 104 can thus be used in the stage depicted in FIG. 3 in processing both piston crown 34 and piston skirt 36. Tool 106 can be used in subsequent processing of only piston crown 34 to achieve the desired smoothness, as discussed herein. It is contemplated that tool 106, including a polishing or burnishing tool, or still another, can remove exposed piston body material or plastically deform exposed piston body material in all of piston lands 66, 68, and 70, and potentially also in piston ring grooves 72, 74, and 76, but is not used in processing piston skirt 36. Those skilled in the art will appreciate that a variety of different tools, techniques, and different processing cells, fixtures, or other apparatus and techniques might be used. To achieve the desired Ra in deposit-sensitive zone 82, crown outer surface 34 might be polished, electropolished, laser polished, or treated by way of other known techniques such as so-called super machining. Tool 106 might thus have a variety of forms.

In a practical implementation strategy employing any of the various possible techniques, piston body 32 may be received for processing in the stages depicted in FIG. 3 and FIG. 4 already having a basic form, such as that produced by casting or forging, and rough machining, and the desired smoothness then produced. Processing piston body 32 will include decreasing a surface roughness of piston crown 34 by at least one of removal or deformation of exposed piston body material in deposit-sensitive zone 82, and increasing a smoothness of the exposed piston body material based on the decreasing of the surface roughness to a deposit-inhibiting smoothness that is at least an order of magnitude smoother than a smoothness in a deposit-insensitive zone of piston body 32. The deposit-inhibiting smoothness might be an Ra of 0.0002 millimeters or less, for example. As noted above, the deposit-insensitive zone of piston body 32 might include skirt outer surface 38, or another surface for example. Piston body 32 may also include one or more as-cast surfaces or one or more as-forged surfaces, which may have a roughness more than an order of magnitude, such as multiple orders of magnitude, greater than crown outer surface 34 in deposit-sensitive zone 82. Skirt inner surface 40 might be as-cast or as-forged, gallery surfaces 65 might be as-cast or as-forged, for example.

INDUSTRIAL APPLICABILITY

Determining what surfaces present suitable or optimum targets for smoothing according to the present disclosure can be determined by simulation or empirically, for example, by observing locations of deposit formation upon pistons after having been used in service in an internal combustion engine. It is contemplated that factors such as fuel spray angle, combustion temperatures, and/or operating temperature ranges, lubricating oil flow, coolant flow, duty cycle, fuel type and/or quality, and many other factors can influence both the formation locations and deposit load experienced by any particular piston. Empirical observations can also assist in determining what portion of a crown outer surface, such as an entirety of a crown outer surface, or only one land, one piston ring groove, multiple lands and multiple grooves, or some other combination, should be targeted for smoothing to inhibit or mitigate deposit formation and/or adhesion. It is contemplated the present disclosure is applicable to newly manufactured pistons as well as remanufactured pistons removed from service in an internal combustion engine.

Figure 5:
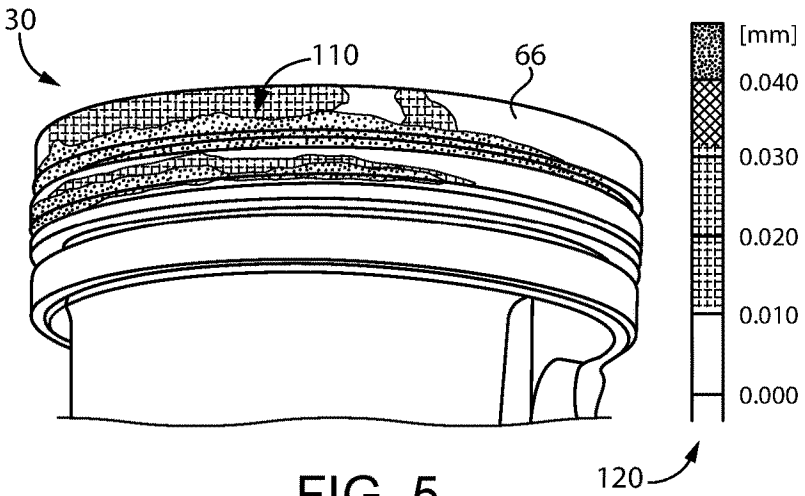
FIG. 5 is a scanning image of a piston according to the present disclosure after service in an internal combustion engine.
Figure 6:
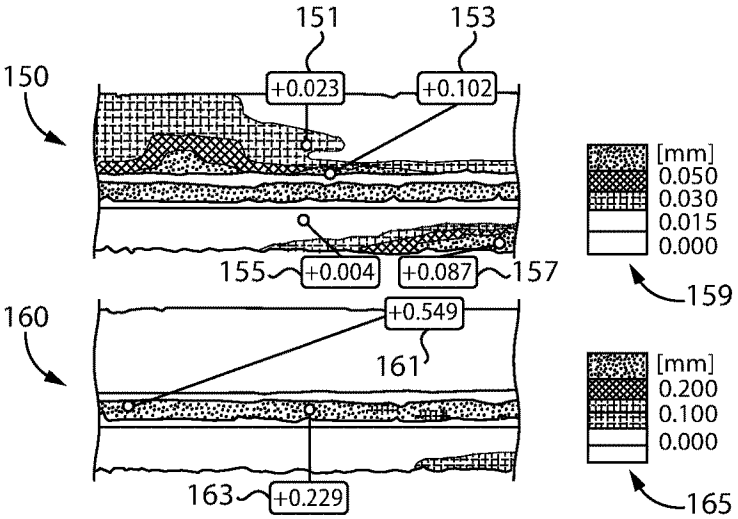
FIG. 6 is a view of scanning images of the piston of FIG. 5 populated with deposit measurements.

Referring now to FIG. 5, there is shown piston 30 according to the present disclosure as it might appear in a scanning image after service in an internal combustion engine, where the scanning image shows the relative locations and thickness of deposits 110 upon top land 66, and elsewhere. A scale in millimeters is shown at reference numeral 120. FIG. 6 includes a first image 150 of a portion of top land 66, top ring groove 72, and second land 68 where populated with deposit thickness measurements at several points as might be used in calculating an average deposit thickness. Deposit thickness measurements are shown at numerals 151, 153, 155, and 157, and a deposit thickness scale in millimeters is shown at 159. FIG. 6 also includes an image 160 populated with measurements of maximum piston deposit thicknesses, including a measurement 161 and a measurement 163, and a deposit thickness scale in millimeters at 165.

Figure 7:
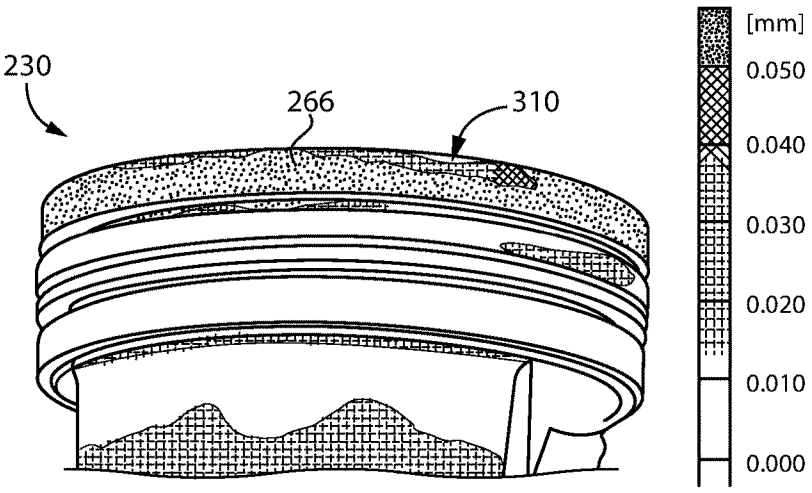
FIG. 7 is a scanning image of a piston of known design after service in an internal combustion engine.
Figure 8:
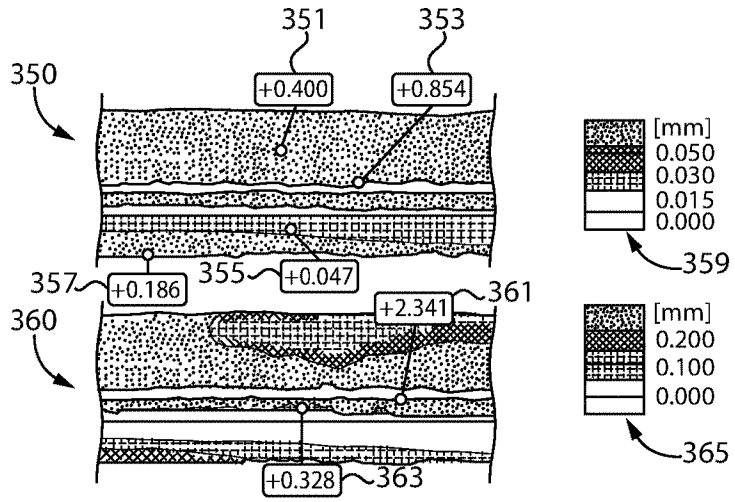
FIG. 8 is a view of scanning images of the piston of FIG. 7 populated with deposit measurements.

Referring now to FIG. 7, there is shown a piston 230 according to a known design having a top land 266 and deposits 310 thereon. A deposit thickness scale in millimeters is shown at 320. FIG. 8 shows an image 350 of deposit thickness measurements 351, 353, 355, and 357 as might be used in calculating an average deposit thickness. A deposit thickness scale is shown in millimeters at 359. FIG. 8 also includes another image 360 populated with maximum deposit thickness measurements 361 and 363, and a deposit thickness scale at 365.

The pistons and data shown in FIGS. 5 and 6 represent actual test data for a piston according to the present disclosure where top land 66 is smoothed to a mirror finish Ra of 0.000125 millimeters or less, and after service in a diesel engine. Piston 230 as depicted in FIGS. 7 and 8 represents actual test data for a known design where top land 266 is conventionally smoothed, such as to an Ra of 0.0002 millimeters or greater, and after service in a diesel engine substantially identical to that of piston 30. It can be seen by comparing the FIGS. 5 and 6 images to the FIGS. 7 and 8 images that piston 30 experiences relatively less average thickness, less maximum thickness, and overall less spatial coverage of deposits. Accumulation totals in piston 30 may be more than 60% less than in piston 230.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A piston for an internal combustion engine comprising:

a piston body including a piston crown defining a piston center axis, and a piston skirt attached to the piston crown;

the piston skirt including a skirt outer surface and a skirt inner surface;

the piston crown including a crown outer surface, and a combustion face formed by an annular outer rim surface and a combustion bowl surface radially inward of the annular outer rim surface;

the crown outer surface forming a plurality of piston lands alternating axially with a plurality of ring grooves and together defining a deposit-sensitive zone;

at least one of the skirt outer surface or the skirt inner surface has a roughness number (Ra) of 0.002 millimeters or greater; and wherein the plurality of piston lands includes a top land, a second land, and a third land, and the crown outer surface is smoothed within the top land to the Ra of 0.0002 millimeters or less.

2. The piston of claim 1 wherein the crown outer surface is smoothed within each of the second and third lands to the Ra of 0.0002 millimeters or less.

3. The piston of claim 1 wherein the crown outer surface is smoothed within at least one of the plurality of piston ring grooves to the Ra of 0.0002 millimeters or less.

4. The piston of claim 1 wherein the crown outer surface is smoothed within the portion of the deposit-sensitive zone to an Ra of 0.00015 millimeters or less.

5. The piston of claim 4 wherein the crown outer surface is smoothed within the portion of the deposit-sensitive zone to a mirror-finish Ra of 0.000125 millimeters or less.

6. A piston for an internal combustion engine comprising:

a piston body including a piston crown defining a piston center axis, and a piston skirt attached to the piston crown;

the piston crown including a crown outer surface, and a combustion face formed by an annular outer rim surface and a combustion bowl surface radially inward of the annular outer rim surface;

the crown outer surface forming a plurality of piston lands alternating axially with a plurality of piston ring grooves and together defining a deposit-sensitive zone, the plurality of piston lands including a top land, a second land, and a third land; and the piston crown being formed throughout of a piston body material having an exposed surface smoothness that is varied within the piston crown, and the crown outer surface is smoothed within the top land to a roughness average (Ra) of 0.0002 millimeters or less.

7. The piston of claim 6 wherein:

the piston skirt is formed throughout of the piston body material and includes a skirt inner surface and a skirt outer surface; and the piston body material has an exposed surface smoothness that is smoothest in the deposit-sensitive zone and varies by at least an order of magnitude between the deposit-sensitive zone and at least one of the skirt outer surface or the skirt inner surface.

8. The piston of claim 6 wherein the piston body material has an Ra of 0.00015 millimeters or less within the deposit-sensitive zone.

9. The piston of claim 8 wherein the piston body material has a mirror-finish Ra of 0.000125 millimeters or less within the deposit-sensitive zone.

10. The piston of claim 8 wherein the crown outer surface is smoothed within each of the second and third lands to the Ra of 0.0002 millimeters or less.

11. The piston of claim 6 wherein the piston body material has the Ra of 0.0002 millimeters or less within a portion of the deposit-sensitive zone including at least one of the plurality of piston ring grooves.

12. The piston of claim 6 wherein the piston body material has the Ra of 0.0002 millimeters or less within an entirety of the deposit-sensitive zone.

13. A method of preparing a piston for service in an internal combustion engine comprising:

receiving a piston body of the piston including a piston crown defining a piston center axis and having a crown outer surface extending circumferentially around the piston center axis and formed by an exposed piston body material extending throughout the piston crown, the crown outer surface forming a plurality of piston lands alternating axially with a plurality of ring grooves and together defining a deposit-sensitive zone, the plurality of piston lands including a top land, a second land, and a third land; and decreasing a surface roughness of the piston crown by at least one of removal or deformation of the exposed piston body material in a deposit-sensitive zone of the piston body defined by a plurality of piston lands and a plurality of piston ring grooves each formed by the crown outer surface; and increasing a smoothness of the exposed piston body material based on the decreasing of the surface roughness to a deposit-inhibiting smoothness that is at least an order of magnitude smoother than a smoothness in a deposit-insensitive zone of the piston body, and the crown outer surface is smoothed within the top land to a roughness average (Ra) of 0.0002 millimeters or less.

14. The method of claim 13 wherein the increasing of the smoothness includes increasing the smoothness to a roughness average (Ra) of 0.00015 millimeters or less.

15. The method of claim 14 wherein the increasing of the smoothness includes increasing the smoothness to a mirror-finish Ra of 0.000125 millimeters or less.

16. The method of claim 14 wherein the decreasing of the surface roughness includes decreasing surface roughness of each of the top land, the second land, and the third land.

17. The method of claim 16 wherein the decreasing of the surface roughness includes decreasing surface roughness of the exposed piston body material forming at least one of the piston ring grooves.

18. The method of claim 16 wherein the decreasing of the surface roughness includes decreasing surface roughness of the exposed piston body material forming all of the piston lands.

* * * * *